US005640811A

United States Patent [19]

Boyle et al.

[11] Patent Number: 5,640,811

[45] Date of Patent: Jun. 24, 1997

[54] OUTDOOR DOME BIASED RAFTER-BRACE, RAFTER-BRACE AND FOUR-WAY CONNECTOR FRAMEWORK

[76] Inventors: Marvin L. Boyle; Beverly A. Boyle, both of P.O. Box 347, Ione, Oreg. 97843

[21] Appl. No.: 406,019

[22] Filed: Mar. 17, 1995

[51] Int. Cl.[6] ..... E04B 1/32

[52] U.S. Cl. ..... 52/86; 4/498; 52/93.1; 52/646; 52/653.2; 52/655.1; 135/142; 135/908; 403/109; 403/170

[58] Field of Search ..... 4/498; 52/82, 86, 52/93.1, 639, 641, 645, 646, 653.2, 655.1, 726.1; 135/114, 139, 140, 142, 908, 909; 403/109, 170, 377

[56] References Cited

U.S. PATENT DOCUMENTS

| | | | |
|---|---|---|---|
| Re. 30,774 | 10/1981 | Dahlbeck et al. | 4/498 |
| 2,212,455 | 8/1940 | Reed | 403/170 X |
| 2,511,452 | 6/1950 | Anderson et al. | 135/909 X |
| 2,928,403 | 3/1960 | Hoskins | 135/142 |
| 3,423,767 | 1/1969 | Crook | 4/498 X |
| 3,475,768 | 11/1969 | Burton | 4/498 X |
| 3,683,427 | 8/1972 | Burkholz . | |
| 3,766,573 | 10/1973 | Burkholz et al. | 4/498 |
| 3,855,643 | 12/1974 | Sanford et al. | 52/86 X |
| 4,092,809 | 6/1978 | Bellas et al. | 52/86 X |
| 4,648,734 | 3/1987 | Daus, Jr. et al. | 403/170 |
| 4,864,795 | 9/1989 | Burg | 52/646 |

*Primary Examiner*—Carl D. Friedman
*Assistant Examiner*—Kevin D. Wilkens
*Attorney, Agent, or Firm*—Floyd E. Ivey

[57] ABSTRACT

An improved framework is disclosed supporting a dome above an outdoor dome covering such as an outdoor swimming pool or other outdoor structure. The improved framework provides additional structural support by the inclusion of a circumferential row of rafter-braces connected by four-way connectors and interspersed with a plurality of biased rafter-braces. The biased rafter-braces are composed of a first tube having an open end sized to receive a second tube and to allow slidable and rotatable movement therebetween. A helical compression spring is disposed within the first tube to secure the first and second tubes together so that they provide a telescoping function by urging the first tube into a first four-way connector tube and the second tube into a second four-way connector tube over a range of distances between four-way connectors. A plurality of substantially equally spaced biased rafter-braces are disposed throughout the circumferential row of rafter-braces thereby allowing greater structural support and stability of the dome covering.

1 Claim, 7 Drawing Sheets

OUTDOOR DOME BIASED RAFTER-BRACE, RAFTER-BRACE AND FOUR-WAY CONNECTOR FRAMEWORK

FIELD OF THE INVENTION

The present invention relates generally to a framework supporting a dome above an outdoor structure such as an outdoor swimming pool and more specifically to an improved framework providing additional structural support by the inclusion of a circumferential row of rafter-braces connected by four-way connectors and interspersed with a plurality of biased rafter-braces providing greater structural support and stability of the outdoor dome covering for domes including circular, oval or other plan configurations.

BACKGROUND OF THE INVENTION

Unenclosed and unprotected outdoor activities including outdoor swimming pool utilization is subject to and often limited by the weather. Outdoor enclosures include domes, coverings and enclosures(hereafter referred to generally as outdoor domes) constructed of a framework covered by a flexible or rigid membrane or sheet material (hereafter referred to as covering material). Such domes provide protection of the activity and the individuals involved from the weather and extend the period of reasonable use of such devices as outdoor swimming pools into cooler months. However, climates sustaining any significant winds will subject outdoor domes to wind loads frequently causing dome damage including framework distortion and even collapse. Such damage, especially that involving framework not only disrupts the use of outdoor swimming pools and subjects the activities and users to potential injury but also requires reassembly and reconstruction of the dome and replacement of bent or otherwise damaged framework members or rafters. The inconvenience and destruction is frequently extensive resulting in difficult and expensive repairs. Presently existing and available dome framework features, for domes with circular, oval or other plan configurations, fail to provide sufficient resistance to wind loading. Existing and available frameworks do not reasonably allow for increasing or adjusting tension within the either the framework structure or covering material thereby lessening structural support and stability. Additionally, existing and available frameworks do not provide sufficient structural components thereby increasing the vulnerability of domes to damage and collapse by wind loading.

As a result, there has been a long-felt need for an improved outdoor dome framework for circular, oval or other plan configurations that: (1) allows adjustment to or increased frame tension and or covering material tension; (2) incorporates increased structural components thereby increasing structural integrity and stability; (3) is easy to install; and (4) is relatively inexpensive. The present invention is directed to satisfying this need. The underlying outdoor dome framework is described by Burkholz el al U.S. Pat. No. 3,683,427 regarding an outdoor swimming pool dome supported by a framework with no reference to provisions, similar to those provided for herein, for increasing or adjusting tension within the either the framework structure or covering material. Burkholz is disclosed via an Information Disclosure Statement in accordance with 37 CFR 1.97.

SUMMARY OF THE INVENTION

In accordance with the present invention, an improved outdoor dome framework is disclosed. The improved outdoor dome framework provides additional structural support by the inclusion of a circumferential rafter assembly comprised of a circumferential row of rafter-braces, interspersed with biased rafter-braces connected by four-way connectors and interconnected, by said four-way connectors, with the usual outdoor dome framework. The improved outdoor dome framework provides, by use of rafter-braces and biased rafter-braces, for adjustment of and increased tension within the framework structure and covering material in outdoor domes, including swimming pool domes, with circular, oval or other plan construction.

The usual dome framework is composed of a plurality of rafter assemblies joined at the upper end at the dome peak by a connection means. The lower end of the individual rafter assemblies are affixed to a foundation surface by a connection means. The foundation surface in the case of an outdoor swimming pool is the top ledge of the swimming pool containment structure. The rafter assemblies are composed of two or more rafter components or tubes of substantially uniform diameter(upper and lower rafter components) which are joined by means intermediate between the foundation surface and the dome peak. One means by which the upper and lower rafter components are joined is by terminating one end of the lower rafter component with a shoulder from which extends a tube portion with an outside diameter which will be received into one end of the upper rafter component where said end of the upper rafter component has an inside diameter such as to encounter the said lower rafter component shoulder thereby concluding the extent of insertion of the upper rafter component.

This usual outdoor dome framework is improved by the present invention by the inclusion of a circumferential rafter assembly composed of a row of rafter-braces and biased rafter-braces connected by four-way connectors approximately midway between the foundation surface and the dome peak. The rafter-braces, biased rafter-braces and four-way connectors comprise the circumferential rafter assembly components and when assembled comprise the circumferential rafter assembly. The circumferential rafter assembly is incorporated into the usual outdoor dome framework by connecting each upwardly extending rafter assembly lower and upper rafter component into opposing four-way connector tubes of a four-way connector.

The rafter-brace is a tube of substantially uniform diameter sized to be received into one tube of the four-way connector. A biased rafter-brace is composed of a first tube of substantially uniform diameter having a first end sized to be received into a four-way connector tube and a second end open and sized to receive the first end of a second tube, of substantially uniform diameter, and to allow slidable and rotatable movement therebetween. A helical compression spring is disposed, by a helical compression spring disposing means, within the first tube, is received into the second tube and by a helical compression spring tube securing means secures the first and second tubes together so that they provide a telescoping function between the first and second tubes. Rotatable movement is allowed between the helical compression spring and the second tube by means of the helical compression spring securing means tracking the helical compression spring coils during rotation of the second tube thereby repositioning the second tube relative to the first tube allowing adjustment of the length of the biased rafter-brace. The second end of the biased rafter-brace is sized to be received into a four-way connector tube. The helical compression spring, as biasing means, urges said first and second tubes of the biased rafter-brace against the respective four-way connector tube shoulder or lower rafter component thereby creating the desired tension within the circumferential rafter assembly.

The rafter-brace and biased rafter-brace tubing may be constructed of any structural material including preferably a lightweight material such as polyvinyl chloride(pvc) or other plastic material, aluminum or other metal and wood. The rafter-brace may be of stock tubing and would generally be constructed of lightweight metal such as aluminum or other material. The biased rafter-brace is composed generally of lightweight tubing metal such as aluminum or other material. The biasing means of the biased rafter-brace is commonly a helical compression spring. However, the biased rafter-brace biasing means or biased rafter-brace function may be accomplished by other biasing means including hydraulic cylinders biased by compressed air or other fluids, electric motor (or other power source) driven gears and other mechanical means of biasing or increasing tension. An example of an available biased rafter-brace is a multipurpose tension rod commonly used in showers, closets and laundry areas from which is suspended curtains and clothing.

A four-way connector is constituted of four tubes having open ends joined to form a 90 degree angle between each adjacent tube so that the four tubes form a cross shape. The open end of each tube of the four-way connector is sized to receive one of the end of a rafter-brace or a biased rafter-brace. The four-way connector may be a stock component as used in lawn sprinkler and irrigation system construction and may be constructed of polyvinyl chloride(pvc) or other plastic material, aluminum or other metal and wood. An example of available pvc parts which forms the four-way connector 5 is provided by Genova Products, Inc. Davison, Mich. 48428, part number 34407.

The circumferential row of rafter-braces, connected by four-way connectors, is interspersed with biased rafter-braces. The number of biased rafter-braces is determine by the extent of tension desired within the outdoor dome framework. The general sized circular outdoor dome framework will utilize three biased rafter-braces while the oval outdoor dome framework will utilize four biased rafter-braces.

The telescoping function of the biased rafter-brace, interspersed in the circumferential rafter assembly, urges the first tube of a biased rafter-brace into a four-way connector tube of a first four-way connector and the second tube of the biased rafter-brace into a four-way connector tube of a second four-way connector over a range of distances between first four-way and second four-way connectors. A plurality of substantially equally spaced biased rafter-braces are disposed throughout the circumferential rafter assembly thereby allowing greater structural support and stability of the outdoor dome framework by means of the tension added from the compression of the helical compression spring or other biasing means.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
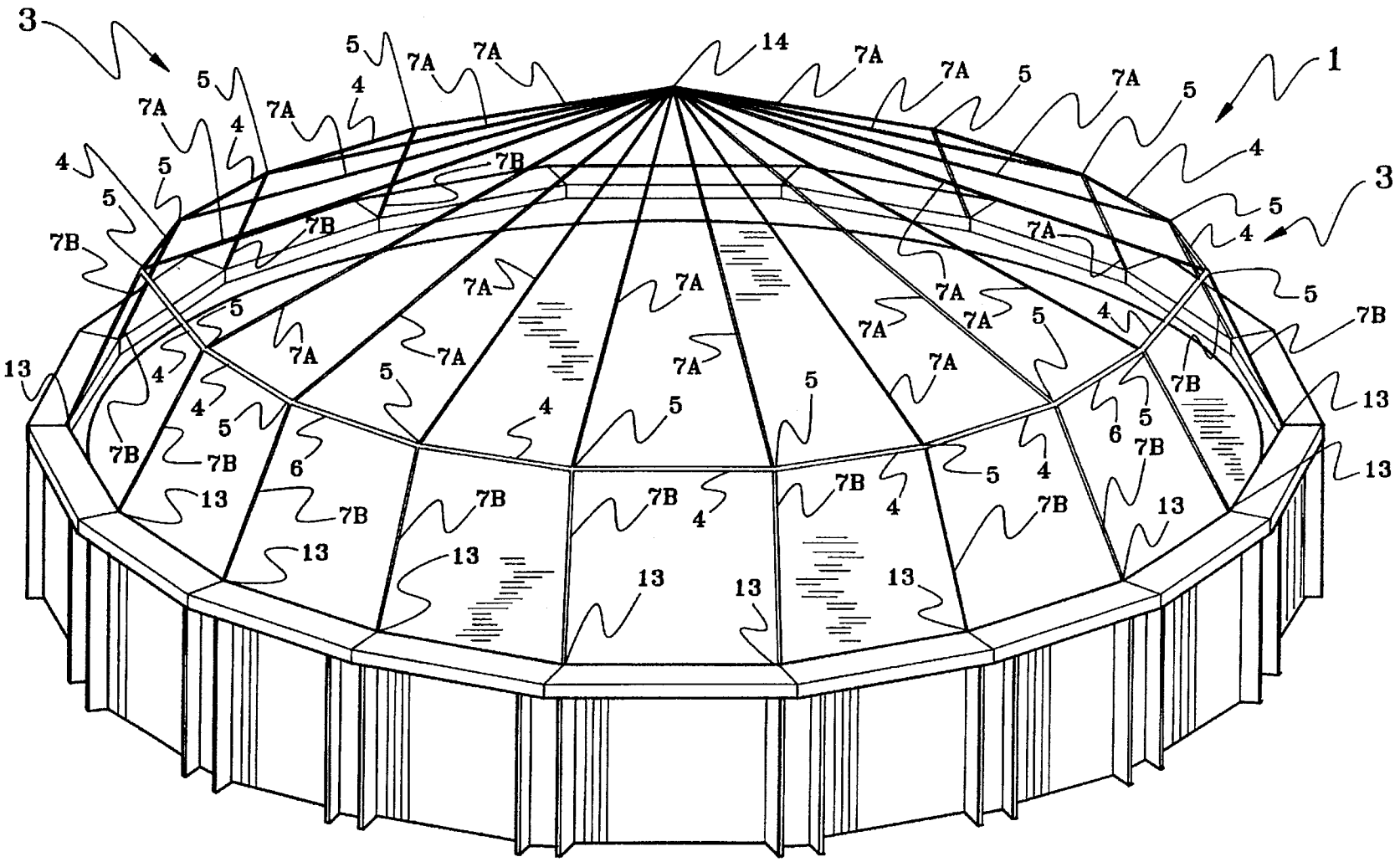
FIG. 1 is a perspective view of a circular outdoor dome framework with the Outdoor Dome Biased Rafter-Brace, Rafter-Brace and Four-Way Connector Framework depicted.
Figure 2:
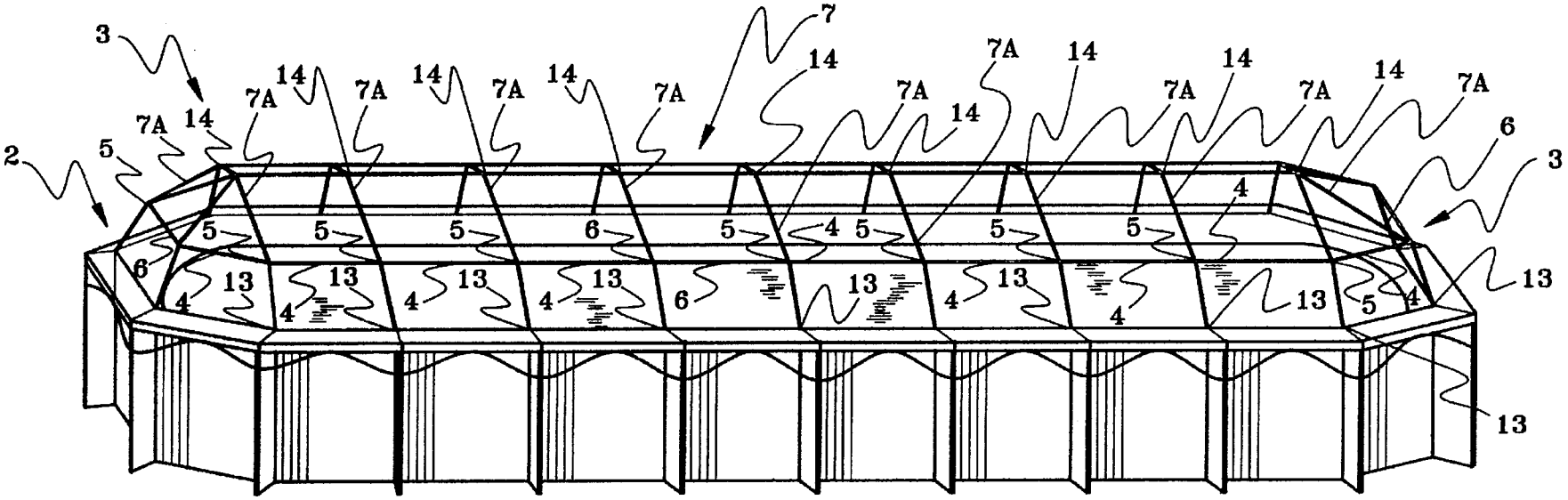
FIG. 2 is a perspective view of a oval outdoor dome framework with the Outdoor Dome Biased Rafter-Brace, Rafter-Brace and Four-Way Connector Framework depicted.
Figures 4, 5:
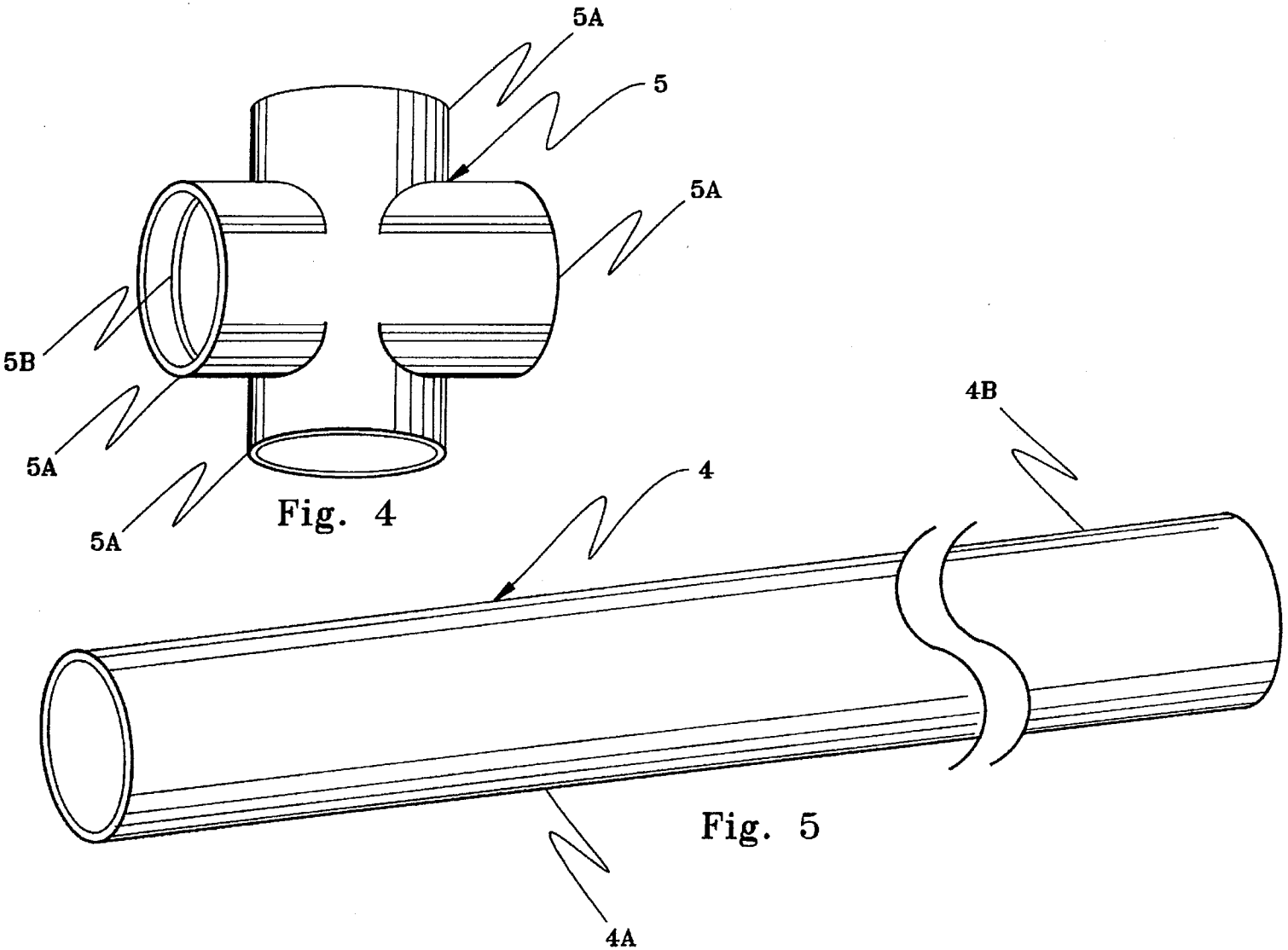
FIG. 4 is a perspective view of the four-way connector of the type provided by GENOVA, part number 34407.
FIG. 5 is a perspective view of the rafter-brace.

Illustrations FIG. 1 and 2 depict assembled circular and oval outdoor dome frameworks 1, 2 including the preferred embodiment of the improvement of a circumferential rafter assembly 3 comprising a circumferential row of rafter-braces 4 interspersed with biased rafter-braces 6 connected by four-way connectors 5 and interconnected, by said four-way connectors 5, with the outdoor dome framework 1, 2. FIG. 5 illustrates the rafter-brace 4 showing a tube, having a first and a second end 4A, 4B sized to be received into one four-way connector tube 5A of a four-way connector 5.

Figures 3, 3A, 3B:
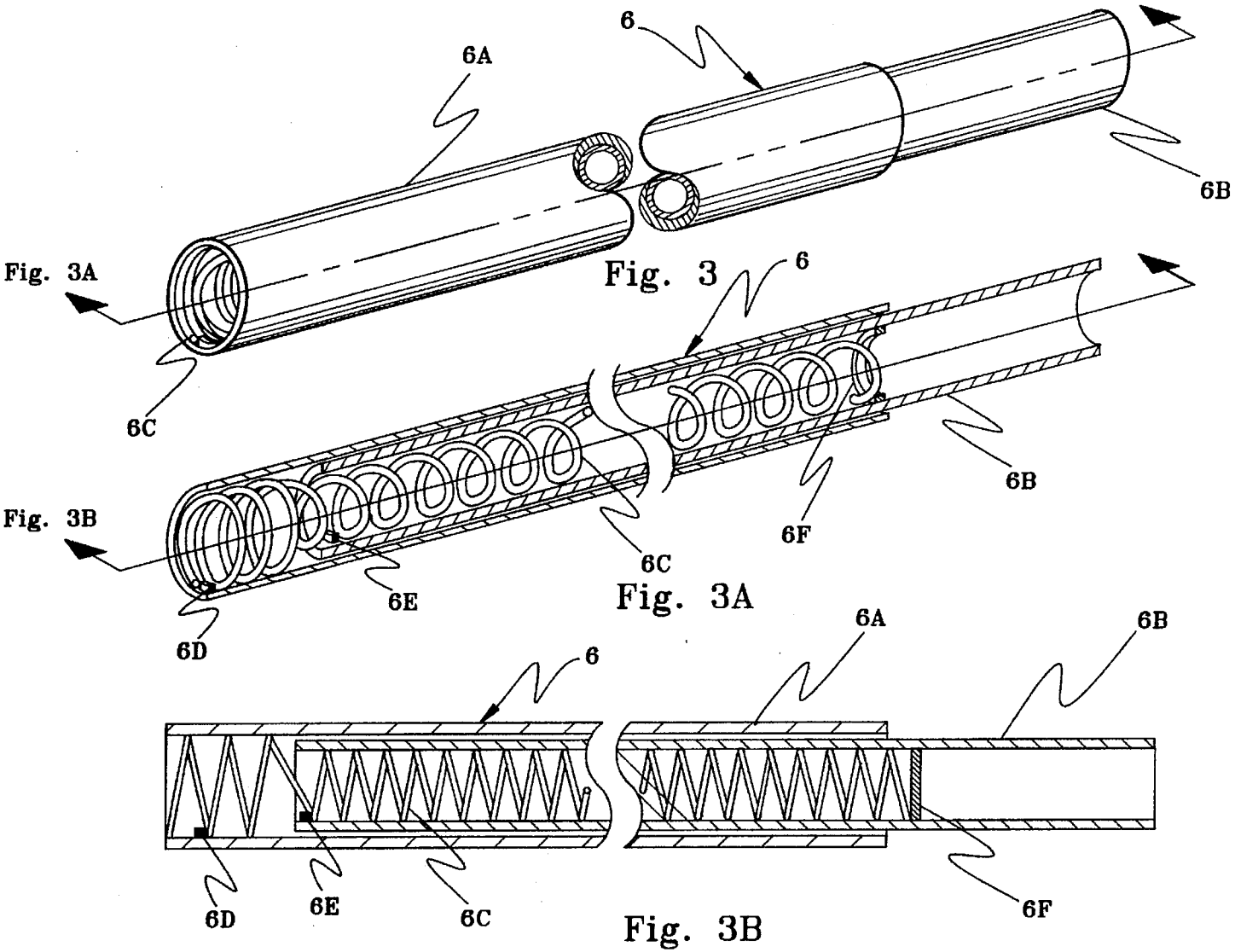
FIG. 3 is a perspective view of the assembled biased rafter-brace.
FIG. 3A is a perspective of section view A-A of the assembled biased rafter-brace depicting the first and second biased rafter-brace tubes and the helical compression spring disposed, by a helical compression spring disposing means, within the first biased rafter-brace tube and by a helical compression spring tube securing means secured to the second biased rafter-brace tube permitting a telescoping function between the first and second biased rafter-brace tubes.
FIG. 3B is an elevation of section view A-A of the assembled biased rafter-brace depicting the first and second biased rafter-brace tubes and the helical compression spring disposed, by a helical compression spring disposing means, within the first biased rafter-brace tube and by a helical compression spring tube securing means secured to the second biased rafter-brace tube permitting a telescoping function between the first and second biased rafter-brace tubes.

A biased rafter-brace 6, illustrated by FIG. 3, is composed of a first tube 6A having a first end sized to be received into one four-way connector tube 5A of a four-way connector 5 and a second end open to receive the first end of a second tube 6B and to allow slidable and rotatable movement therebetween. A helical compression spring 6F is disposed, by a helical compression spring disposing means 6D, for example by a protrusion, within the first tube 6A, and is received into the second tube 6B and by a helical compression spring tube securing means 6E, provided for example by a protrusion, secures the first and second tubes 6A, 6B together so that they provide a telescoping function. Rotatable movement is allowed between the helical compression spring 6F and the second tube 6B by means of the helical compression spring securing means 6E tracking the helical compression spring coils 6C during rotation of the second tube 6B thereby repositioning the second tube 6B relative to the first tube 6A allowing adjustment of the length of the biased rafter-brace 6. The helical compression spring 6F, as biasing means, urges the first and second tubes 6A, 6B of the biased rafter-brace 6 against the respective four-way connector tube shoulder 5B or lower rafter component 7B thereby creating the desired tension within the circumferential rafter assembly. The second end of the biased rafter-brace 6 is sized to be received into one four-way connector tube 5A of a four-way connector 5. The rafter-brace 4 and biased rafter-brace 6 tubing may be constructed of any material including preferably a lightweight material such as polyvinyl chloride or other plastic material, aluminum or other metal. The rafter-brace 4 may be of stock tubing and would generally be constructed of lightweight metal such as aluminum or other metal or polyvinyl chloride or other plastic material.

A four-way connector 5, illustrated by FIG. 4, is constituted of four four-way connector tubes 5A having open ends joined to form a 90 degree angle between each adjacent four-way connector tube 5A so that the four tubes form a cross shape. The open end of each tube of the four-way connector tubes 5A is sized to receive an end of a rafter-brace 4, a biased rafter-brace 6, an upper rafter component 7A or a lower rafter component 7B. Internal to each four-way connector tube 5A is a four-way connector tube shoulder 5B. The four-way connector 5 may be a stock component as used in lawn sprinkler and irrigation system construction and may be constructed of polyvinyl chloride or other plastic material or metal such as aluminum or other material.

Figure 6:
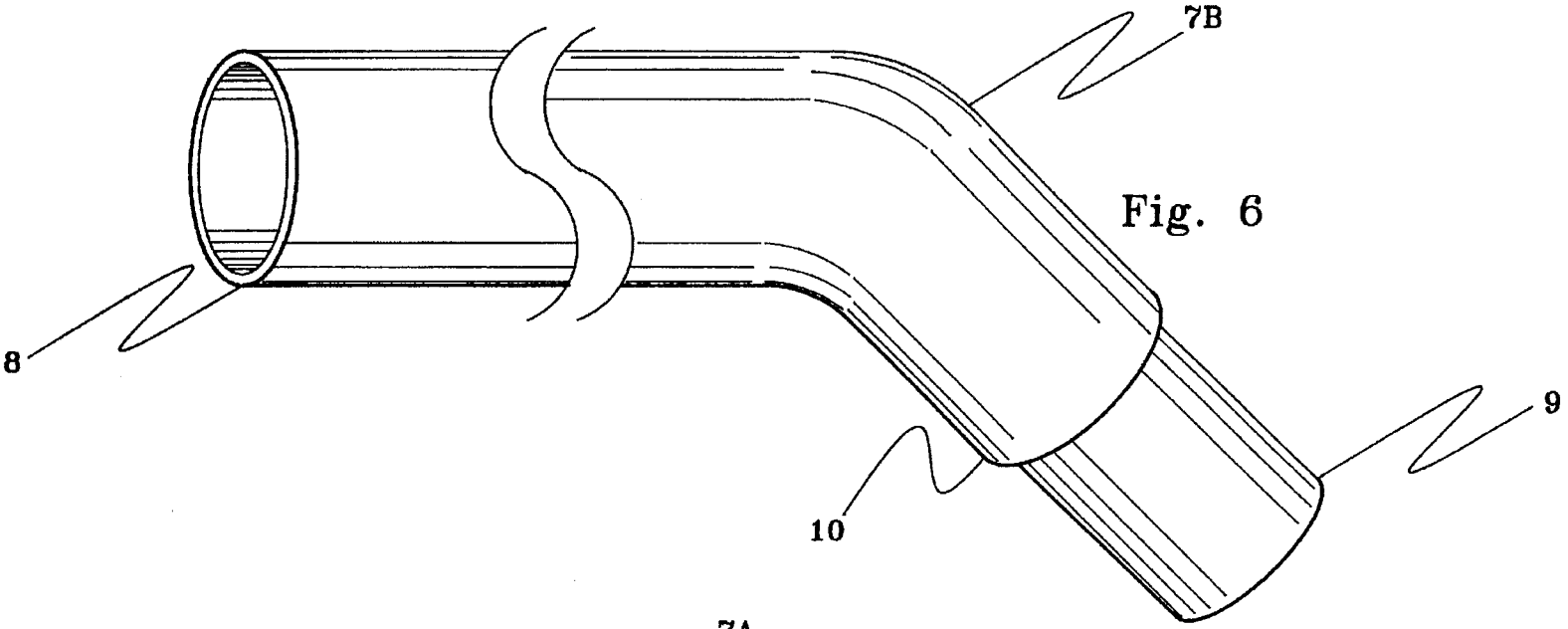
FIG. 6 is a perspective view of the lower rafter component.
Figure 7:
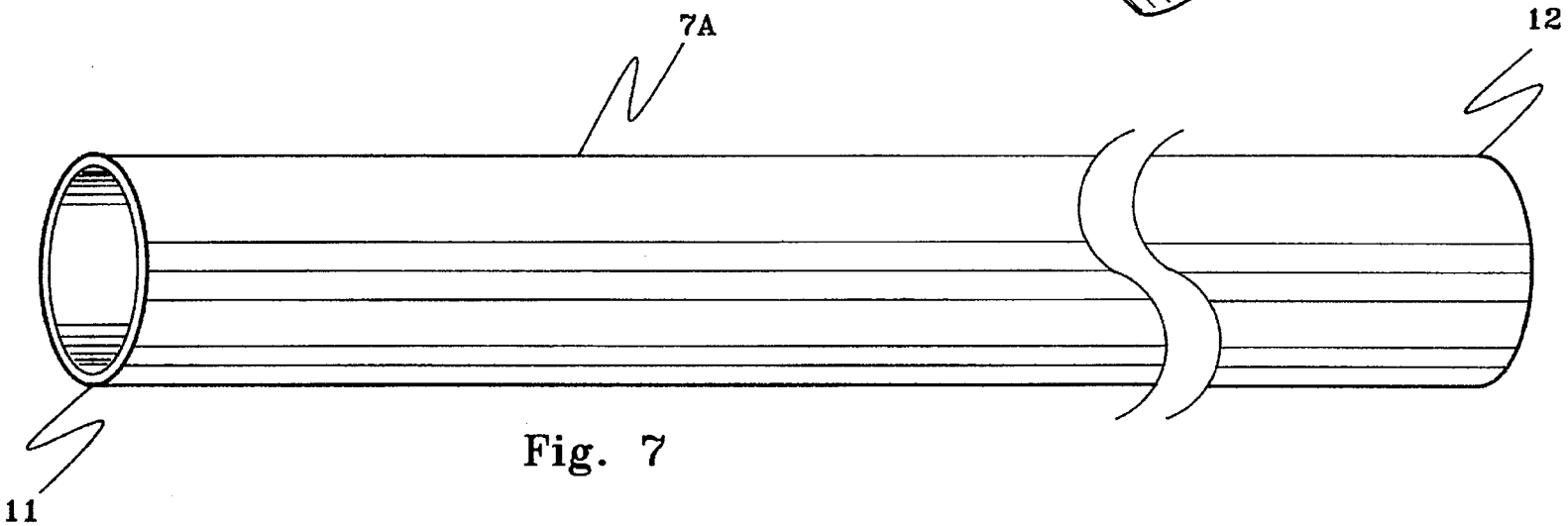
FIG. 7 is a perspective view of the upper rafter component.
Figure 9B:
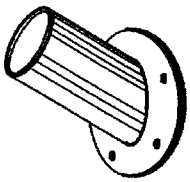
FIG. 9, 9A and 9B show a plan, elevation and perspective view of the foundation surface connection means (13).
Figure 9A:
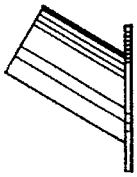
Figure 9:
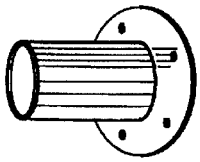
Figure 10D:
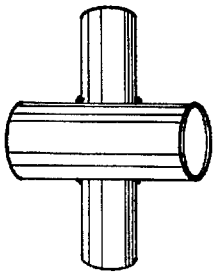
FIG. 10C, 10D and 10E illustrate a front elevation, plan and perspective view of a variation of the dome peak connection means (14) as shown in FIG. 2 as the dome peak connection means between the end most points of a oval outdoor dome framework.
Figure 10C:
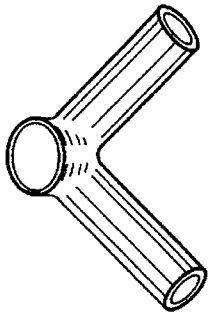
Figure 10B:
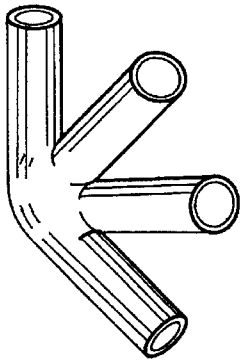
Figure 10A:
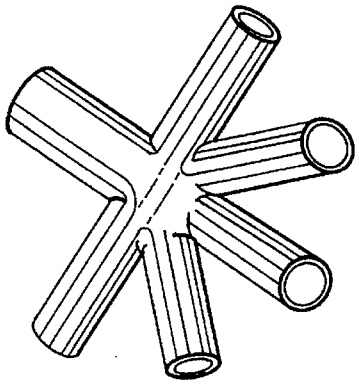
Figure 10G:
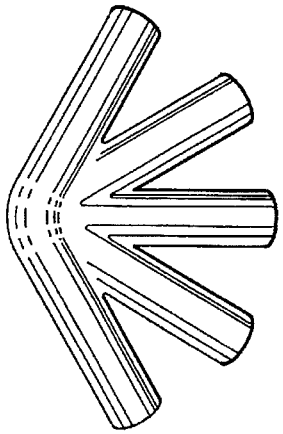
FIG. 10F and 10G illustrate a plan view and perspective of a variation of the dome peak connection means (14) as illustrated in FIG. 1 for a circular outdoor dome framework.
Figure 10F:
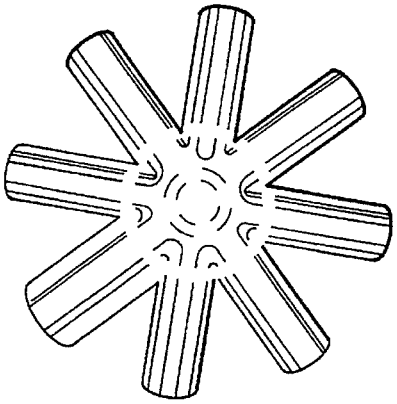
Figure 10E:
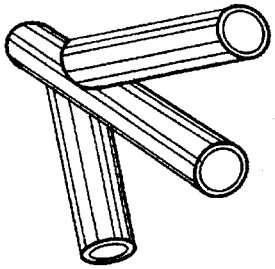

A plurality of rafter assemblies 7 extend upwardly from foundation surface connection means 13 (as shown in FIGS. 9, 9A and 9B) and are received into a dome peak connection means 14 (as demonstrated generally in FIGS. 10, 10A through 10G) to form the framework for the usual outdoor dome 1, 2. Each upwardly extending rafter assembly 7 may be composed of at least two tubes or upper and lower rafter components 7A and 7B, as shown in FIG. 6 and 7, each having a first and second end. The first end 8 of the lower rafter component 7B is received into the foundation surface connection means 13. The second end 9 of the upwardly extending lower rafter component 7B is sized to be received into one four-way connector tube 5A of a four-way connector 5 as shown in FIG. 4. The lower rafter component shoulder 10 is sized to encounter a four-way connector tube shoulder 5B thereby concluding the extent of insertion. The first end 11 of the upper rafter component 7A is received into the four-way connector tube 5A opposing the inserted lower rafter component 7B and is sized to receive the second end 9 of the lower rafter component 7B.

Figure 8:
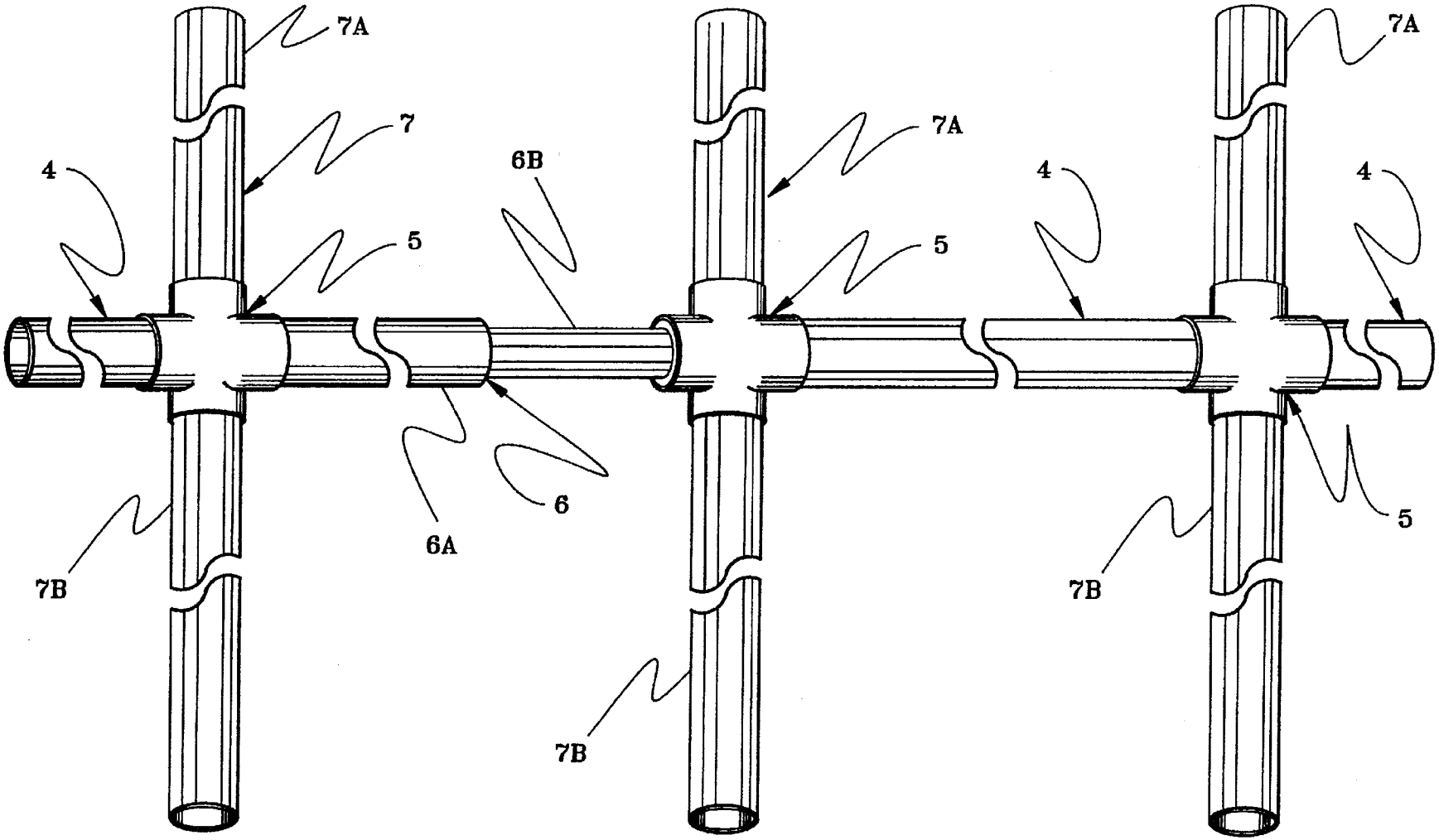
FIG. 8 shows the circumferential rafter assembly incorporated into the usual dome framework.
Figure 10:
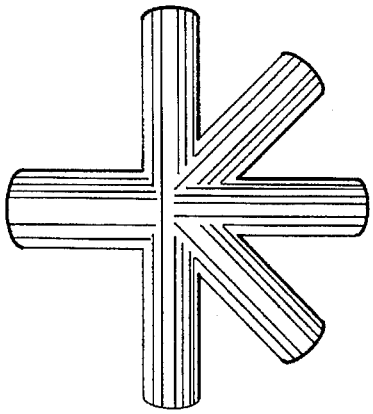
FIG. 10, 10A and 10B illustrate a plan, perspective and side elevation view of a variation of the dome peak connection means (14) shown in two locations in FIG. 2 as the dome peak connection means at the end most points of a oval outdoor dome framework.

The first and second ends of a plurality of rafter-braces 4 are inserted into four-way connector tubes 5A around the circumference of the outside dome. A number of biased rafter-braces 6 are interspersed among the rafter-braces 4 sufficient to provide desired tension within the outside dome framework 1, 2 for sufficient structural stability. FIG. 8 illustrates a detail showing the interconnection of rafter assemblies, by means of four-way connectors, with the circumferential row of rafter-braces interspersed with biased rafter-braces.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. An Outdoor Dome Biased Rafter-Brace and Four-Way Connector Framework comprising:

A. a plurality of rafter-braces each having a first and a second end; said rafter-braces are tubes of substantially uniform diameter;

B. a plurality of biased rafter-braces each having a first and a second end; said biased rafter-braces are composed of a first and second tube each having a first and second end;

C. a plurality of four-way connectors each having four four-way connector tubes sized to receive the first or second end of any of said rafter-braces or biased rafter-braces; each four-way connector tube having a four-way connector tube shoulder disposed therein; each biased rafter-brace biased against the four-way connectors within which it is received with the first end sized to be received into one four-way connector tube and the second end open to receive the first end of said second tube and allow slidable movement therebetween; said second tube of substantially uniform diameter with said second end received into a four-way connector tube; a helical compression spring disposed, by a helical compression spring disposing means, comprised of a disposing protrusion, within the first tube and received into the second tube by a helical compression spring tube securing means, comprised of a securing protrusion, securing the first and second tubes of the said biased rafter-brace together so that they provide a telescoping function; rotatable movement allowed between the helical compression spring and the second tube by means of the helical compression spring securing means tracking the helical compression spring coils during rotation of the second tube thereby repositioning the second tube relative to the first tube allowing adjustment of the length of the biased rafter-brace;

D. the first and second end of one rafter-brace received respectively each into four-way connector tubes; the first and second ends of others of a plurality of rafter-braces received sequentially into four-way connector tubes opposing the four-way connector tubes receiving each preceding and following rafter-brace to form a circumferential row; biased rafter-braces interspersed among the said rafter-braces within the circumferential row with the first and second ends of each biased rafter-brace received into four-way connector tubes opposing the four-way connector tubes receiving each preceding and following rafter-brace within said circumferential row to comprise a circumferential rafter assembly; each biased rafter-brace biased against the four-way connectors within which it is received;

E. a plurality of upwardly extending rafter assemblies comprised of an upper and lower rafter component each having a first and second end;

F. the first end of each lower rafter component received into a foundation surface connector means; the second end of each upwardly extending lower rafter component received into one four-way connector tube within the circumferential rafter assembly; a lower rafter component shoulder sized to encounter the four-way connector tube shoulder thereby concluding the extent of insertion;

G. the first end of each upper rafter component received into the four-way connector tube opposing the inserted second end of the lower rafter component and receiving the second end of the lower rafter component and encountering the four-way connector shoulder thereby completing the rafter assembly; and the second end of each upper rafter component received into a dome peak connection means thereby completing construction of the outdoor dome framework and the incorporation of the circumferential rafter assembly into the outdoor dome framework.

* * * * *